US007551747B2

(12) United States Patent
Huynh et al.

(10) Patent No.: US 7,551,747 B2
(45) Date of Patent: Jun. 23, 2009

(54) PERFORATED CAP FOR A HEARING AID

(75) Inventors: Timothy Cuongdung Huynh, San Jose, CA (US); Greg Anderson, Fremont, CA (US); Sunder Ram, San Jose, CA (US); Dean Johnson, Solana Beach, CA (US); Richard Gable, Sunnyvale, CA (US); Robert Schindler, San Francisco, CA (US); Pat Contioso, Sunnyvale, CA (US); Gregory Kushner, El Sobrante, CA (US); Richard Carl Urso, Redwood City, CA (US); Adnan Shennib, Dublin, CA (US)

(73) Assignee: InSound Medical, Inc., Newark, CA (US)

( * ) Notice: Subject to any disclaimer, the term of this patent is extended or adjusted under 35 U.S.C. 154(b) by 662 days.

(21) Appl. No.: 11/058,097

(22) Filed: Feb. 14, 2005

(65) Prior Publication Data

US 2006/0215862 A1 Sep. 28, 2006

Related U.S. Application Data

(60) Provisional application No. 60/544,871, filed on Feb. 13, 2004.

(51) Int. Cl.
*H04R 25/00* (2006.01)

(52) U.S. Cl. ..... 381/325; 381/324; 381/322; 381/328

(58) Field of Classification Search ..... 381/322, 381/324, 325, 328, 72, 380
See application file for complete search history.

(56) References Cited

U.S. PATENT DOCUMENTS

| | | | | |
|---|---|---|---|---|
| 5,105,904 | A * | 4/1992 | Olsen | 181/128 |
| 5,401,920 | A | 3/1995 | Oliveira | |
| 7,298,857 | B2 * | 11/2007 | Shennib et al. | 381/324 |
| 7,313,245 | B1 * | 12/2007 | Shennib | 381/325 |
| 2007/0086611 | A1 * | 4/2007 | Rafferty | 381/325 |

OTHER PUBLICATIONS

Ballachanda, The Human Ear Canal, Singular Publishing, 1995, pp. 195.

* cited by examiner

*Primary Examiner*—Curtis Kuntz
*Assistant Examiner*—Jasmine Pritchard
(74) *Attorney, Agent, or Firm*—Townsend and Townsend and Crew LLP

(57) ABSTRACT

Embodiments of the invention provide a protective cap assembly for a CIC hearing aid. The assembly comprises a perforated cap configured to be mounted over the lateral end of the hearing aid to protect the hearing aid from contaminants. At a least a portion of the cap includes a protective coating and a plurality of perforations. The placement and size of the perforations can be configured to provide sufficient aeration and drainage to reduce a relative humidity of the cap interior when the hearing aid is positioned in the ear canal. The perforations also operate as sound conduction channels for conducting sound to the cap interior. The perforations have a minimum size wherein a single perforation provides sufficient acoustic transmittance to a hearing aid component such that a hearing aid performance parameter is not substantially adversely affected. They can also be configured to provide splash protection for the cap interior.

35 Claims, 11 Drawing Sheets

PERFORATED CAP FOR A HEARING AID

CROSS-REFERENCES TO RELATED APPLICATIONS

This application claims the benefit of priority of U.S. Provisional Patent Application Ser. No. 60/544,871, filed on Feb. 13, 2004, the full disclosure of which is incorporated herein by reference. The application is related to the following commonly-assigned applications: U.S. patent application Ser. No. 11/053,656, filed on Feb. 7, 2005; and U.S patent application Ser. No. 11/053,174, filed on Feb. 7, 2005, the full disclosure of each being incorporated herein by reference. This application is also related to U.S. Provisional Patent Applications: Ser. No. 60/696,276, filed on Jun. 30, 2005; and Ser. No. 60/696,265, filed on Jun. 30, 2005, the full disclosure of each being incorporated herein by reference.

BACKGROUND OF THE INVENTION

Field of the Invention. Embodiments of invention relate to hearing aids. More specifically embodiments of the invention relate to protective caps for improving the resistance of hearings to exposure from cerumen and other biological contaminants.

Since many hearing aid devices are adapted to be fit into the ear canal, a brief description of the anatomy of the ear canal will now be presented for purposes of illustration. While, the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. These dimensions vary among individuals.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human ear Canal, Singular Publishing, 1995, pp. 195). There is no cerumen production or hair in the bony part of the ear canal.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal.

First generation hearing devices were primarily of the Behind-The-Ear (BTE) type. However, they have been largely replaced by In-The-Canal (ITC) hearing devices are of which there are three types. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. These devices fit deep within the ear canal and can be essentially hidden from view from the outside.

In addition to the obvious cosmetic advantages, CIC hearing devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

However despite their advantages, many CIC hearing devices have performance and reliability issues relating to occlusion effects and the exposure of their components to moisture, cerumen, perspiration and other contaminants entering the ear canal (e.g. soap, pool water, etc.). Attempts have been made to use filters to protect components such as the sound ports of the microphone. However over time, the filters can become clogged with cerumen, and other contamination. Other attempts have been made to seal the entire hearing aid to prevent in the influx of mixture and cerumen; however, such seals can be difficult to both reliably form and test as wells as reducing acoustic conductance to the hearing aid microphone. Also many seals can fail over time due to the high humidity environment in the ear canal resulting in liquid water or vapor entering and becoming trapped inside the hearing aid and then condensing. Accordingly, there is a need for improved moisture and cerumen protection methodologies for CIC hearing aid components.

BRIEF SUMMARY OF THE INVENTION

Embodiments of the invention provide systems and assemblies for improving the long term reliability for extended wear hearing aids including completely in the canal (CIC) hearing aids. More particularly, various embodiments provide systems and assemblies for improving the resistance of various components on CIC and other hearing aid devices to condensation, cerumen and other contaminants when the hearing aid is worn deep in the ear canal on a long term basis.

One embodiment provides a protective cap assembly for improving the resistance of a hearing aid, such as a CIC hearing aid to contaminants and condensation. The assembly comprises a perforated cap configured to be mounted over the lateral end of the hearing aid to protect the hearing aid from contaminants and condensation. The hearing aid can typically include a microphone assembly, a battery assembly and a receiver. In preferred embodiments, the cap will be mounted over the microphone assembly, but can also cover the battery assembly and even a portion of the receiver assembly. At a least a portion of the cap can include a protective coating such as a hydrophobic coating, an oleophobic coating. In one embodiment, the protective coating covers the entire cap. The cap also includes a plurality of perforations or channels. The placement and size of the perforations are configured to provide splash protection for an interior of the cap while providing sufficient aeration and drainage to reduce a relative humidity of the cap interior (e.g., by evaporation and/or drainage) when the hearing aid is positioned in a ear canal of a user. The perforations also operate as sound conduction channels for conducting sound to an interior of the cap. The perforations have a minimum size wherein a single perforation provides sufficient acoustic transmittance to the microphone or other hearing aid component such that a hearing aid performance parameter is not substantially adversely affected. Such parameters can include the output, volume, gain or frequency response of the hearing aid. In a preferred embodiment, the cap is configured to provide sufficient acoustic transmittance to a microphone positioned at least partially within the cap interior wherein the microphone is oriented in a medial direction of the ear canal.

Preferably, the cap is cylindrically shaped but other shapes can also be used such a semicircular or thimble shape. Also, the cap is preferably sized (e.g. diameter, shape, etc) such that the cap does not make substantially contact with, or conform to the shape of an ear canal. Accordingly, in one embodiment the cap can have a slight oval profile to match that of the concha but smaller in size. The cap can also be configured in size and shape to act as receptacle for one or more components of the hearing aid including the microphone assembly, integrated circuit assemblies as well as the battery assembly. Alternatively, the cap can be configured to seal against the battery assembly or a battery membrane barrier or sealing grommet.

In various embodiments, the perforations or channels can be configured to perform several functions including one or more of ventilation, drainage and sound conduction. Such functions can be achieved by the configuration of the size, number of and placements of the perforations. For example, in many embodiments, the size, number and placement of the perforations can be configured to provide sufficient aeration or ventilation (e.g., for evaporation) to minimize condensation within the cap interior due to moisture build up from perspiration, ingress of liquid water or exposure to high humidity ambient conditions. In such embodiments, the perforations are also desirably configured to provide sufficient aeration to at least partially equilibrate the relative humidity of the cap interior with a lower external ambient humidity. In these and related embodiments, such aeration can be achieved by placing the perforations on both the end and side portions or walls of the cap. This placement can be done in a selectable pattern and/or density of perforations.

The perforations can also be configured (e.g. size and placement, etc) to have the cap act as a drain for the outward flow of any water or other liquids that enter the cap or that are produced by perspiration or condensation. The splash guard function of the cap can also be enhanced through the use of a hydrophobic coating which serves to repel any water contacting the cap. In various embodiments, the placement of the perforations can made in a selectable pattern and/or density to optimize both the aeration function of the cap as well as its splash guard function. This combination of functions can also be enhanced through the shape and placement of the perforations. For example, in one embodiment, the perforations can have an inwardly increasing taper configured to reduce the influx of water but without compromising ventilation and/or acoustic conductance. Also, the perforations on the top of the cap can have smaller diameters and/or be fewer in number than those on the sides of the cap. In other embodiments, the perforations can also be configured (e.g. size and placement, etc) to have the cap function as a contaminant guard to inhibit migration of contaminants such as cerumen and skin into the interior of the cap.

In many embodiments, the cap can include one or more fixtures for inserting and/or removing the hearing aid. The insertion fixture can comprise an insertion tab attached to the top portion of the cap. The removal fixture can comprise one or more wires loops attached to one or both of the top or side portions of the cap. In a preferred embodiment, the removal fixture is a three pronged wire loop attached to the top portion of the cap. The cap can be attached to the hearing aid by screws or other joining means, adhesives, heating sealing, ultrasonic welding or other joining method known in the art. In embodiment having a removal fixture, the cap is attached to the hearing aid with sufficient mechanical strength (e.g., pull strength) such that when a removal tool engages the removal fixture the entire hearing aid is pulled out of the ear. The side of the cap an also include one or more grooves, ridges or other raised portions or fittings used for aligning, fitting or locking the cap in place with other components of the hearing aid.

In other embodiments, the cap can include one or more peelable or otherwise removable layers attached to selectable portions of the cap. Preferably, the layer covers at least the perforated portions of the cap. The removable layer is configured to function as an in situ cerumen removal system wherein, when the layer is peeled away any adhered cerumen is removed along with the layer, including cerumen or other contaminants that are blocking the perforations. Also a fresh region of the cap is revealed. Preferably, each peelable layer includes an attached removal loop, such as a suture or other fixture that allows in situ pealing of the layer by a user or medical worker using a removal tool having one or more hooks or other grasping means known in the art. Various aspects of removal tools are described in U.S. patent application Ser. No. 11/053,174 filed Feb. 7, 2005. The peelable layer and the adhesive on layer are configured to allow the layer to be peeled without tearing of the layer, that is the adhesive is a releasable adhesive known in the art and the layer has sufficient mechanical strength to overcome the adhesive (e.g. peal) forces of the adhesive without tearing of the layer. The peal forces are also desirably configured such that they do not result in removal or significant movement of the hearing aid. The peelable layer is configured to have sufficient mechanical strength so as to be able to pull away any cerumen that is blocking the perforations without tearing of the peelable layer. The cap can include multiple peelable layers such that multiple cerumen removing peals can be done over a period of extended wear of the hearing aid in the ear canal. Peals can be done at set time intervals (e.g. monthly) or whenever the user notices a perceptible degradation in performance of the hearing aid (e.g. decreased volume, etc.). In this way, the user can wear the hearing aid for extended periods of time without degradation in performance due to cerumen or other contaminant build up and without having to undergo the inconvenience of removing the hearing aid for purposes of cleaning.

Another embodiment provides a self-ventilated CIC hearing aid device for operation in the bony portion of the ear canal. The device comprises a microphone assembly including a microphone, a receiver assembly configured to supply acoustic signals received from the microphone assembly to a tympanic membrane of a wearer and a battery assembly for powering the device and a cap assembly. The battery assembly being electrically coupled to at least one of the microphone assembly or the receive assembly. The cap assembly includes a cap configured to be mounted over at least a portion of the hearing aid. The cap includes a protective coating and a plurality of perforations. The placement and size of the perforations are configured to provide splash protection for an interior of the cap while providing sufficient and drainage to reduce a relative humidity of the cap interior when the hearing aid is positioned in a ear canal of a user. The perforations have a minimum size wherein a single perforation provides sufficient acoustic transmittance to a hearing aid component such that a hearing aid performance parameter is not substantially adversely affected.

BRIEF DESCRIPTION OF THE DRAWINGS

FIG. 6B shows the cap with an attached cerumen layer, FIG. 6C shows the removal of the removable layer from the cap.

DETAILED DESCRIPTION OF THE INVENTION

Various embodiments of the invention provide system and assemblies for improving the resistance of various components on CIC and other hearing aids to condensation, cerumen and other contaminants when the hearing aid is worn deep in the ear canal on a long term basis. Specific embodiments provide a perforated cap assembly for a hearing aid that protects hearing aid components from water, cerumen and other contaminants while providing ventilation and drainage to reduce internal moisture and humidity as well as providing adequate acoustic transmission to the hearing aid microphone.

Figure 1:
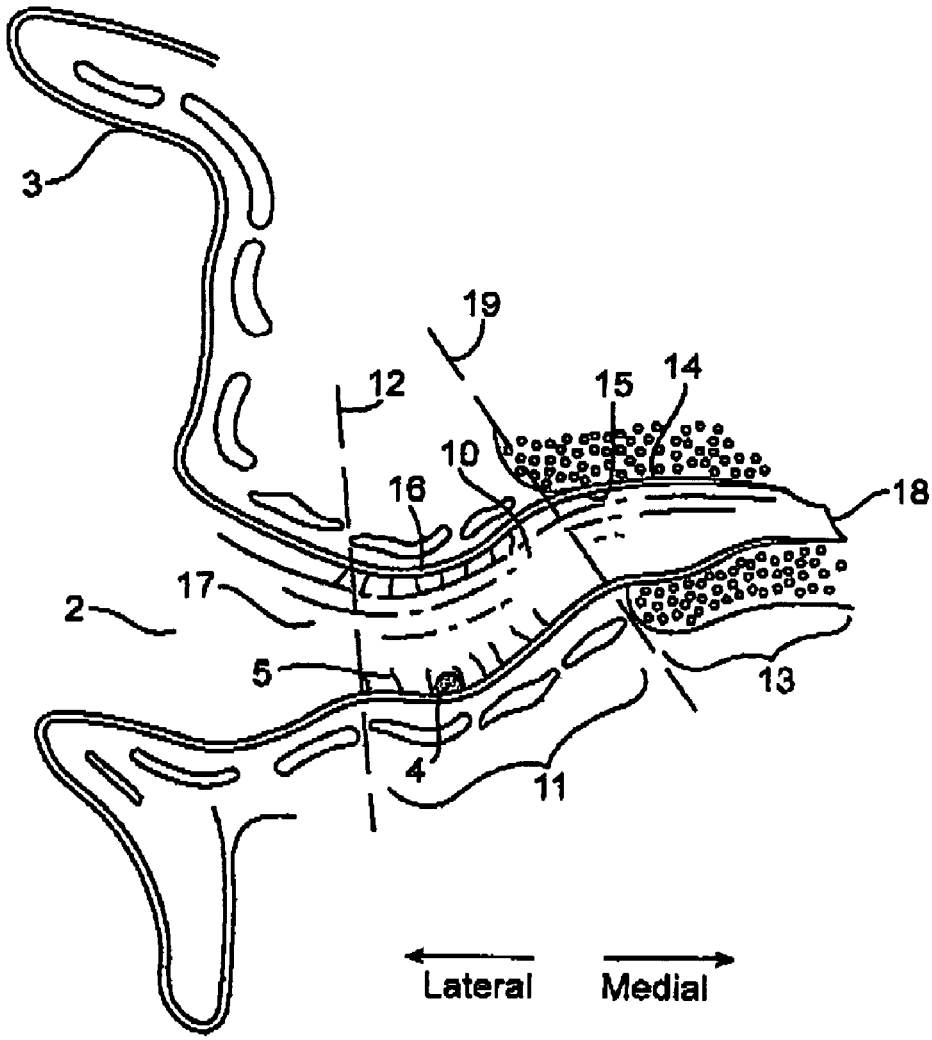
FIG. 1 is a side coronal view of the external ear canal.
Figure 2:
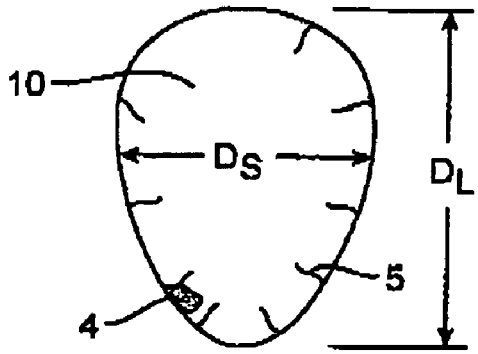
FIG. 2 is a cross-sectional view of the ear canal in the cartilaginous region.
Figure 3:
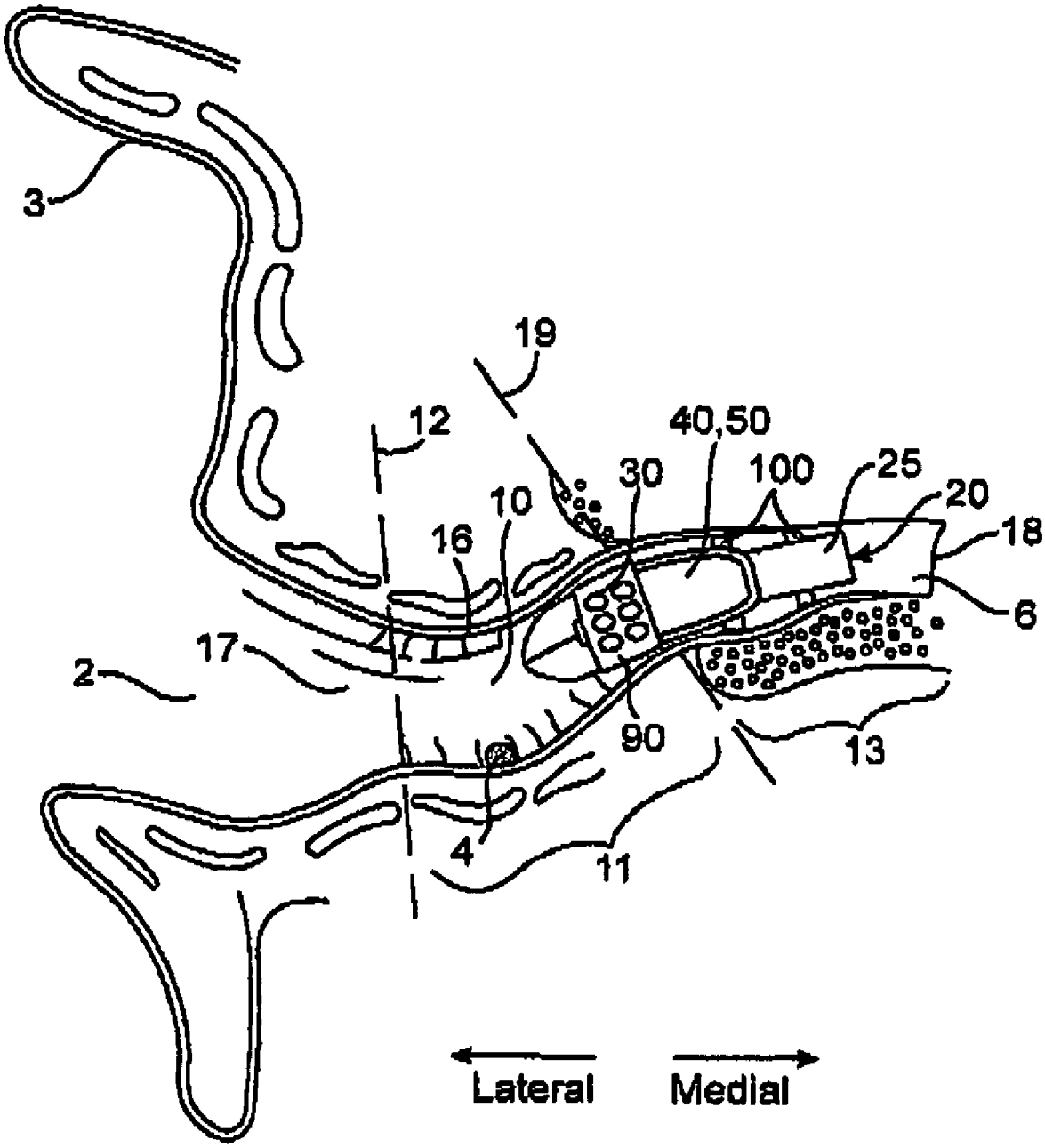
FIG. 3 is a lateral view illustrating an embodiment of a hearing aid device positioned in the bony portion of the ear canal.

Referring now to FIGS. 3-4, an embodiment of a CIC hearing aid device 20 configured for placement and use in ear canal 10 can include a receiver (speaker) assembly 25, a microphone assembly 30, a battery assembly 40, a cap assembly 90 and one or more sealing retainers 100 coaxially positioned with respect to receiver assembly 25 and/or microphone assembly 30. Receiver assembly 25 is configured to supply acoustical signals received from the microphone assembly to a tympanic membrane of the wearer of the device. Battery assembly 40 includes a battery 50, and can also include a battery barrier 60 and a battery manifold 70. Preferably, device 20 is configured for placement and use in the bony region 13 of canal 10 so as to minimize acoustic occlusion effects due to residual volume 6 of air in the ear canal between device 20 and tympanic membrane 18. The occlusion effects are inversely proportion to residual volume 6; therefore, they can be minimized by placement of device 20 in the bony region 13 so as to minimize volume 6. Preferably, device 20 is also configured for extended wear in ear canal 10. In specific embodiments, hearing device 20 including a protective cap 90, can be configured to be worn continuously in the ear canal, including the bony portion, for 3 months, 6 months or even longer.

Referring now to FIGS. 4-5, a discussion will be presented of protective cap 90. The cap can be configured to be mounted over or otherwise coupled to at a lateral end 20L of hearing device 20. In many embodiments, the cap will be configured to mount over most or all of microphone assembly 30. However, the cap can also be configured to be mounted over portions of battery assembly 40 and even portions of receiver assembly 25. In a preferred embodiment, the cap is configured to mount over all of microphone assembly 30 and a portion of battery assembly 40. In particular embodiments, the cap can be configured to mounted over an even form a seal 41 with one or more components of battery assembly 40 such as a battery barrier 60 and/or a battery manifold 70. The cap can also be configured to be seated in or otherwise coaxially coupled to sealing retainer 100.

The cap can have a variety of shapes including, but not limited to, cylindrical, semi-spherical and thimble shaped. In a preferred embodiment, the cap is substantially cylindrically shaped and includes a top portion 92 and a side wall portion 93 and interior or cavity portion 95. Side wall portion 93 defines an open medial portion or opening 94 to cavity portion 95. Opening 94 serves as a conduit for mounting the cap over various portions and/or components of hearing aid 20. The thickness of 90T of side 93 and/or top 92 can be in the range of about 0.001 to about 0.010 inches. Preferably thickness 90T is less than about 0.010 inches and more preferably less than about 0.050 inches. In many embodiments, the cap include one or more perforations 91 which can be configured to perform one or more functions including, without limitation, serving as channels for: i) ventilation for moisture reduction, ii) oxygen supply to the battery; and iii) acoustic conduction to microphone as is discussed herein. Perforations 91 can be positioned in various locations throughout the cap but are preferentially positioned in patterns on the top and sides of the cap. In embodiments in which the cap is seated in a sealing retainer 100, at least a portion of perforations 91 are preferentially placed on the cap so as not be obstructed by the sealing retainer. Also, as is described herein, all or portions of cap 90 can include a protective coating 90*c*, such as a hydrophobic coating.

Figure 5A:
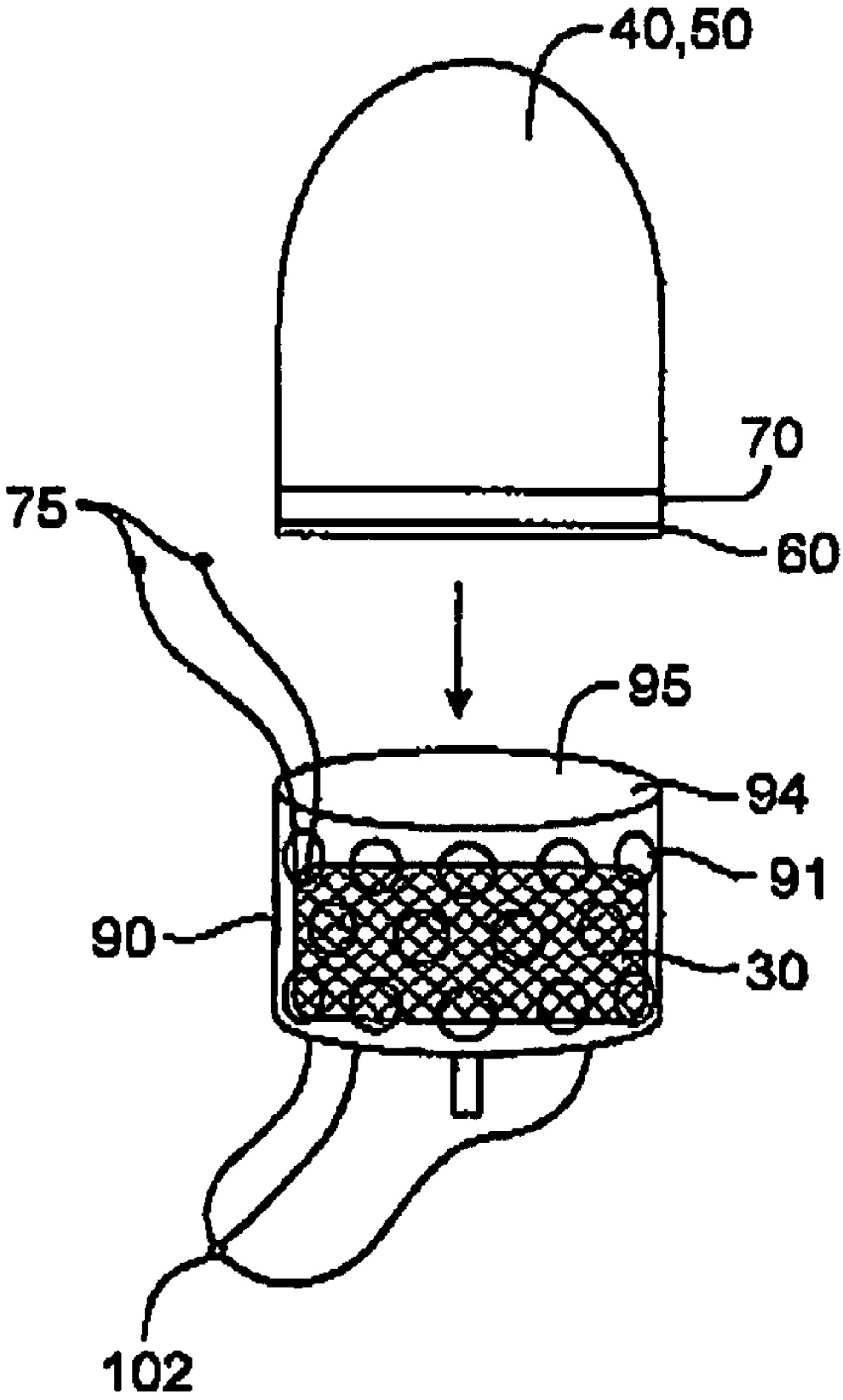
FIG. 5A is a side view illustrating the assembly of an embodiment of the cap assembly onto a hearing aid.
Figure 5B:
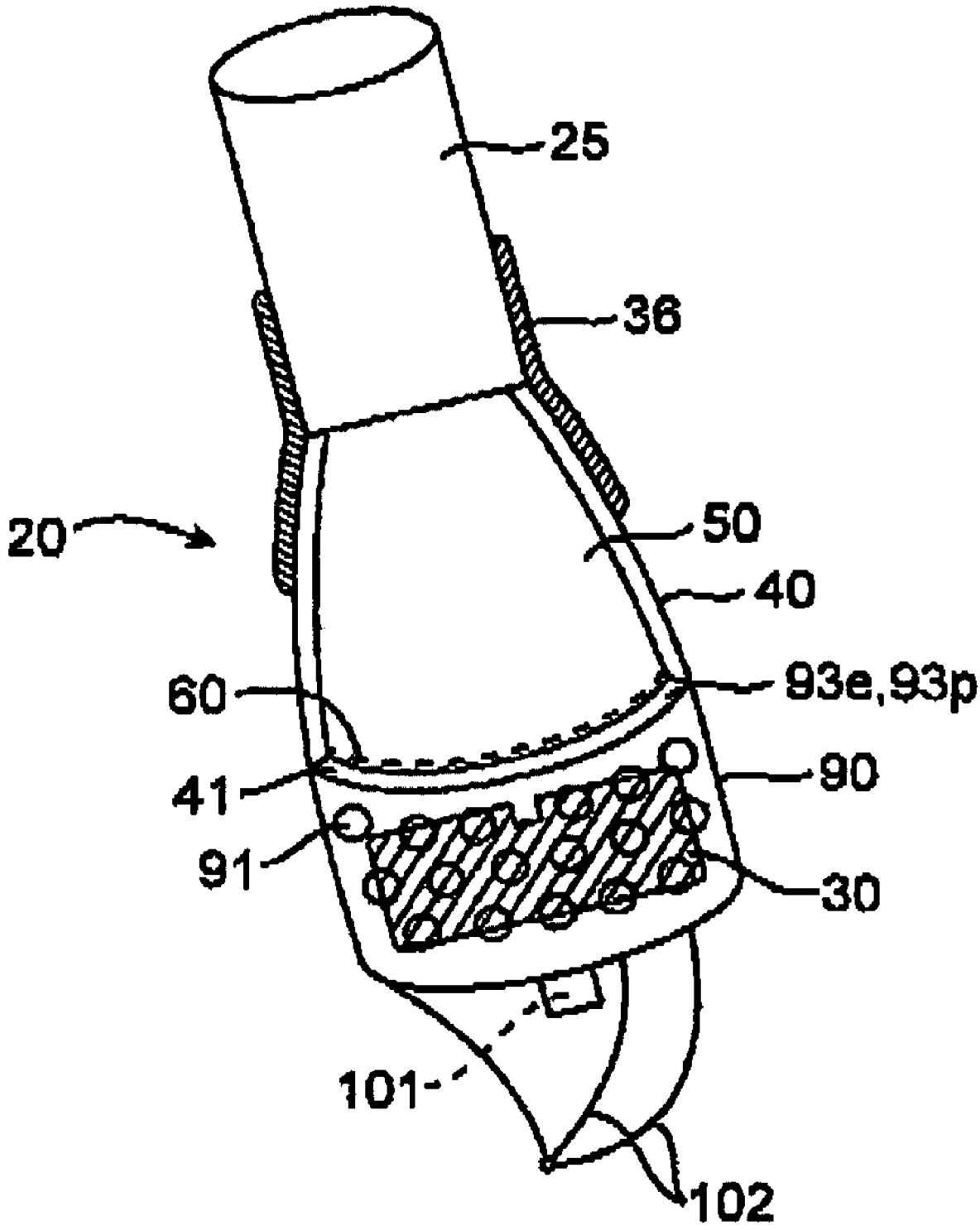
FIG. 5B is a perspective view illustrating the cap assembly of FIG. 5A assembled onto a hearing aid.

In many embodiments, the cap interior 95 has a sufficient volume and shape to serve as a receptacle for various components of hearing aid 20 including, but not limited to, microphone assembly 30 and associated integrated circuit assemblies, battery assembly 40, battery barrier or 60, battery manifold 70, receiver assembly 25 and electrical harnesses or connections 75 for one or more hearing aid components (See FIGS. 5A-5B). After the component or components are placed within the cap interior 95, a setting or encapsulation material can be added. In a preferred embodiment, the cap is configured to serve as a receptacle to the microphone assembly when the microphone is oriented in a medial direction of the ear canal. In such embodiments, the cap is also configured to provide sufficient acoustic transmittance to the microphone assembly such that the hearing aid provides adequate function to the user (e.g., amplification, frequency response, etc). The cap can also be configured to coupled to or form a seal with a flexible coupling or joint 36 coupling one or more components of the hearing aid such as the receiver assembly 25 and the battery assembly 40. In one embodiment, the flexible coupling 36 can comprise elastomeric tubing (e.g., silicone or polyurethane tubing). The elastomeric tubing can be positioned over a portion of the cap and also hold it in place on the hearing aid by a circumferential spring force. Also the elastomeric tubing can be configured to fit under the side portion 93 of the cap. In one embodiment, a perimeter portion 93*p* of the side portion of the cap can itself include an elastic portion 93*e* configured to have sufficient elasticity to fit over and grip the battery assembly 40 (which can be covered by elastomeric tubing 36) with circumferential force so as to form a seal 41 with a portion of the battery assembly. Seal 41 can be watertight or even an air tight seal.

In various embodiments, the cap is sized to fit within the ear canal of a user. The dimension of the cap, such as length, can be adapted for different sized ear canals to provide a custom fit for a given user. Preferably, the cap is sized (e.g. diameter, length and shape, etc.) such that the cap does not make substantially contact with, or conform to the shape of ear canal 10. Accordingly, in one embodiment, the cap has a diameter 90D and cross section profile 90P which is smaller than that of the concha 2 of the user. Also, the cap can have a slight oval profile 90P to match that of the concha but smaller in size. The diameter and profile 90D and 90P can be based on the average diameter of the concha or can be determined by individual measurements of concha of a given user.

The cap can be fabricated from a variety of polymers known in the art including but not limited to one or more biocompatible polymers known in the art such as acrylics, polyesters, polyethylenes, PMMA, polyetherimides, glycol modified polyethylene terephthalate (PETG) and the like. In a preferred embodiment, the cap is fabricated from a PEEK (polyether-ether ketone). This material can be configured to be machined as well as sterilized by gamma radiation, E-beam and ethylene oxide methods without discoloration. The cap can be fabricated using one or more polymer processing and/or machining methods known in the art including without limitation, injection molding, thermal forming, milling, die cutting or drill cut and the like. The perforations can be formed using injection molding of the entire cap or can be drilled or laser cut using methods known in the art. Also, the cap can be attached to hearing aid 20 using one or more joining means known in the art, including, but not limited to, adhesives, heating sealing, heat staking, ultrasonic welding, interference fitting, screws, pins or other joining method known in the art. In a preferred embodiment, the cap is adhered to battery assembly 40 using a biocompatible adhesive known in the art.

As discussed herein, in many embodiments, cap 90 includes one or more perforations 91 also known as channels 91. In various embodiments, the perforations or channels can be configured to perform several functions including one or more of ventilation, (for both moisture reduction and oxygen supply to the battery), drainage, splash protection and sound conduction. Such functions can be achieved by the configuration of the size, number and placements of perforations 91. For example, in many embodiments, the size, number and placement of the perforations can be configured to provide sufficient aeration or ventilation to: i) provide sufficient oxygen to supply the requirements of a metal air battery, such as a zinc-air battery, in powering the hearing aid; and ii) minimize condensation within the cap interior due to moisture build up from perspiration, ingress of liquid water or exposure to high humidity ambient conditions. In such embodiments, the perforations are also desirably configured to provide sufficient aeration to at least partially equilibrate the relative humidity of the cap interior with a lower external ambient humidity. In these and related embodiments, such aeration can be achieved by placing the perforations on both the top 92 and side portions 93 of the cap. In a preferred embodiment for a self-ventilated cap, the cap includes 50 perforations positioned on the top and sides of the cap. In use, such embodiments provide the cap and hearing aid with a self-ventilating capability to reduce moisture and condensation and improve long term reliability and battery life.

The perforations can also be configured (e.g. size and placement, etc) to have the cap acts as a drain 96 for the outward flow of any water or other liquids that enters the cap or that is produced by condensation. In such embodiments, it is desirable to position the perforations on both the top and sides of the cap. The drainage function of the cap together, with its self ventilation ability serves to further enhance the ability of the cap to reduce moisture build up in the cap interior and so protect hearing aid components that may damaged from moisture. The perforations can also be configured (e.g. size and placement, etc) to have the cap function as a splash guard 97 to prevent the direct splashing of water (with or without surfactants during showering, swimming etc.) against hearing device components. The splash guard function of the cap can also be enhanced through the use of a hydrophobic coating which serves to repel any water contacting the cap. In other embodiments, the perforations can be configured to have the cap function as a contaminant guard or filter 98 to filter out or otherwise inhibit the migration of contaminants such as cerumen, skin and hair into the interior of the cap. Such contaminants, can interfere in the functioning of various hearing aid components (e.g. the microphone), thereby potentially damaging the device. In a preferred embodiment, filter 98 is a cerumen filter in which the cap is configured (e.g., perforation size and placement, etc. and application of a cerumenolytic and/or oleophobic coating) to prevent or reduce entry of cerumen into the microphone or the battery assembly.

In various embodiments, the placement of the perforations can made in a selectable pattern 99 and/or density. Such patterns can configured to optimize one or more functions of the cap for example, the ventilation or sound conductance functions. In these embodiments, the perforations are positioned on both the top 92 and sides 93 of the cap. Suitable patterns include placement of perforations in rows 99*r* on the sides and top of the cap. Other patterns of perforations can include, without limitation, circular, square, serpentine and combinations thereof. The number of rows can be in the range of 1 to 5. In an embodiment shown in FIG. 4B, the sides of the cap include three rows with approximately 15 perforations per row; however, this pattern of rows is exemplary and other row patterns (e.g., number of rows, perforations per row) are equally suitable (e.g., 4 rows with 20 perforations per row). In various embodiments, the total number of perforations can be in the range from 20 to 100 with specific embodiments of 30, 40, 50 and 75 perforations. The number of perforations can be selected depending upon the desired attributes in the cap. For example, more perforations can be used to increase the ventilation or sound conduction function of the cap interior. In a preferred embodiment, the cap includes about 50 perforations.

In many embodiments, perforations 91 are configured to operate as sound conduction channels 91*s* for conducting sound to the cap interior 95. In these embodiments, the perforations are configured to conduct sound from the ear canal 10 to a microphone assembly 30 positioned within the cap interior. In a specific embodiment, the perforations are configured to conduct sound to a microphone assembly positioned within the cap interior when the microphone is oriented in a medial direction of the ear canal. The pattern and number of perforations can also be configured to provide a multidirectional sound conduction system to minimize any directional artifacts and to provide redundancy should one or more of the perforations become fouled with cerumen or other contaminants.

The perforations can have variety of shapes including, without limitation, circular, oval and rectangular. In preferred embodiments, a majority of the perforations can be circular shaped. Also, oval shaped perforations can be positioned used along a perimeter edge 92E of the cap top such that the perforation is positioned both on the top 92 and side 93 portion of the cap. In various embodiments using circular or oval shaped perforations, the perforations can be configured to have a minimum diameter 91D (or other dimension for different shapes, e.g. width), wherein even a single perforation 91 provides sufficient acoustic transmittance to the microphone, or other hearing aid component, such that a hearing aid performance parameter is not substantially adversely affected. Such parameters can include, without limitation, the output, volume, gain or frequency response of the hearing aid. The minimum diameter 91D of the perforations can range from about 0.01 to about 0.05 inches, with a preferred embodiment of 0.025 inches.

In various embodiments, the shape and placement of the perforations can be configured to enhance one more functions of the cap. For example, in one embodiment, the perforations can have an inwardly increasing taper configured to reduce the influx of water but without compromising ventilation and/or acoustic conductance. Also, the perforations on the top of the cap can have smaller diameters and/or be fewer in number than those on the sides of the cap. Also, the perforations can be sized and placed so as to not compromise the structural integrity of the cap. That is, the perforations can be placed such that they do not result in the cap significantly deforming or breaking due to compression of the canal from jaw movement (e.g. chewing) or even moderate impact to the head or jaw.

Figure 4A:
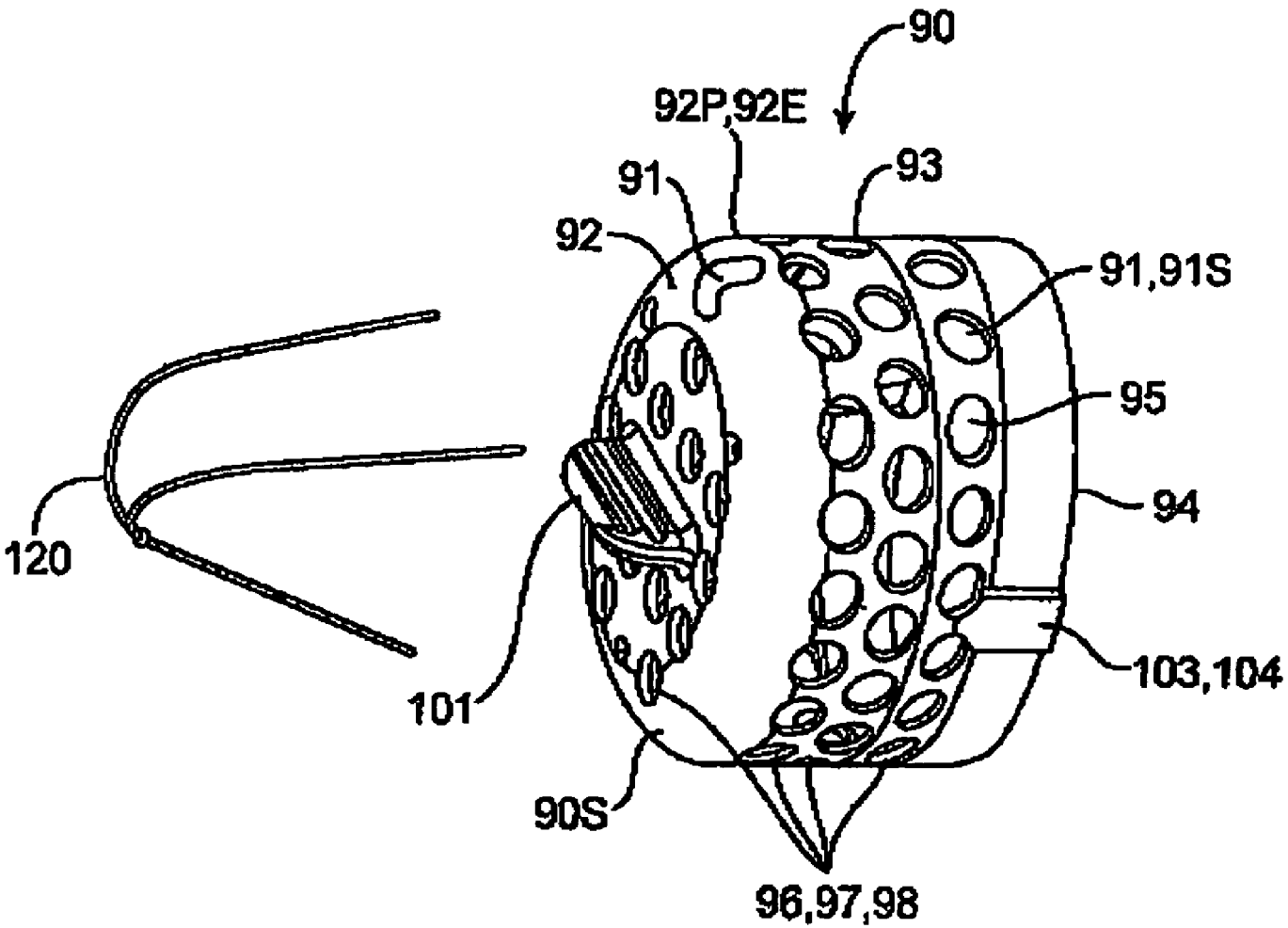
FIG. 4A is a perspective view illustrating an embodiment of the cap assembly including a removal fixture and insertion tabs.
Figure 4B:
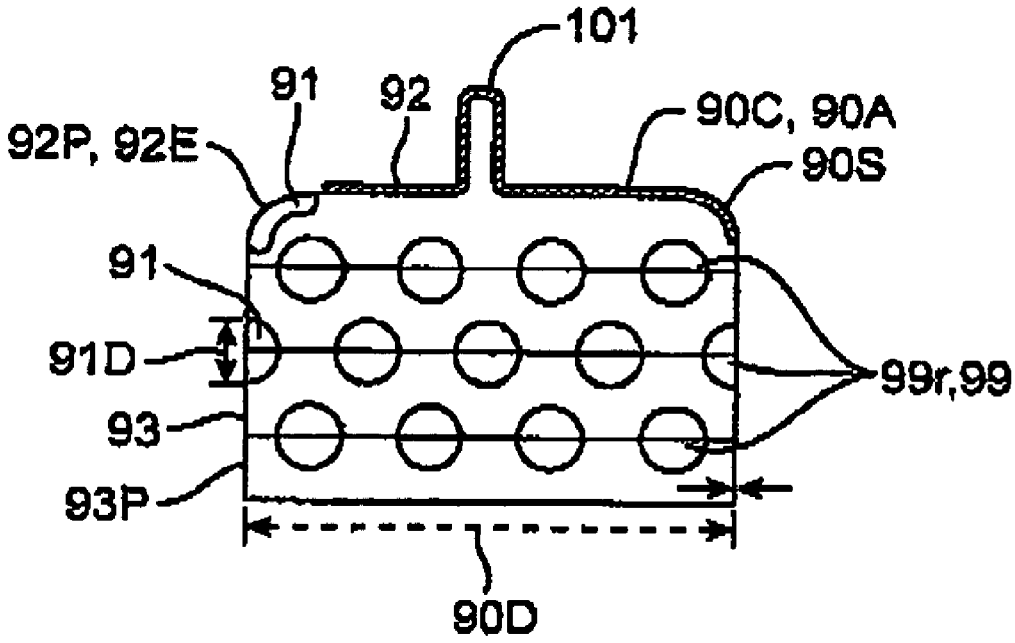
FIG. 4B is a side view of the embodiment of FIG. 4A illustrating a configuration of the perforations in a row pattern on the sides of the cap assembly.
Figure 4C:
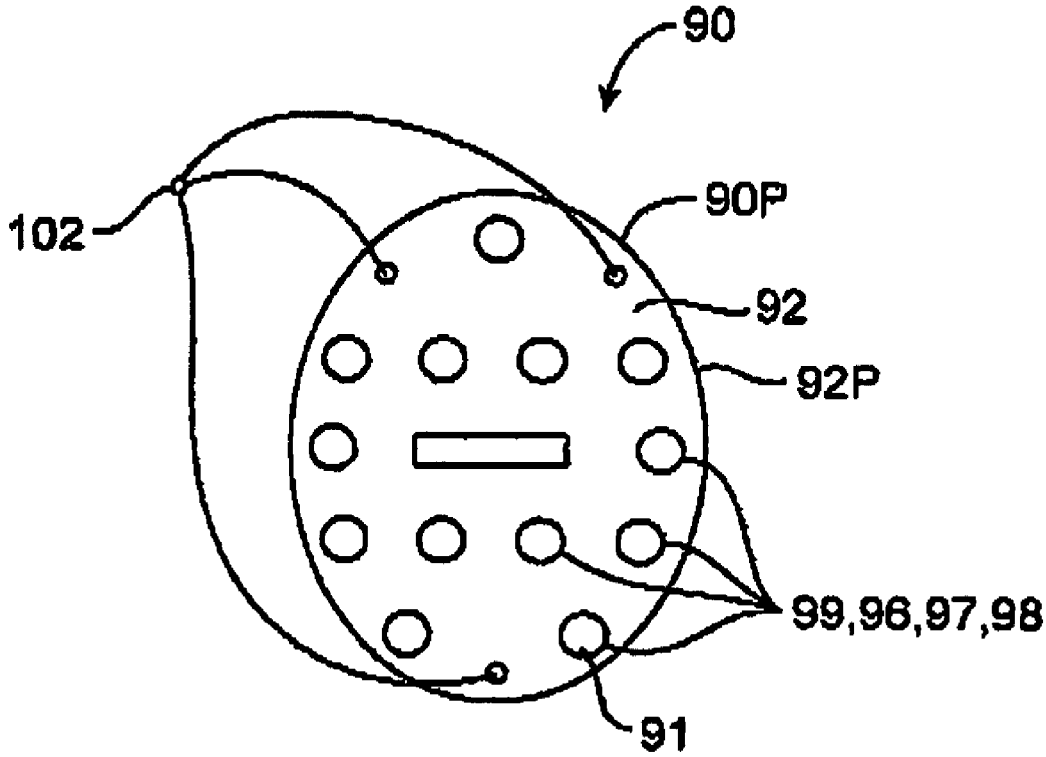
FIG. 4C is a top view of the embodiment of FIG. 4A illustrating a configuration of the perforations on the top of the cap assembly.
Figure 4D:
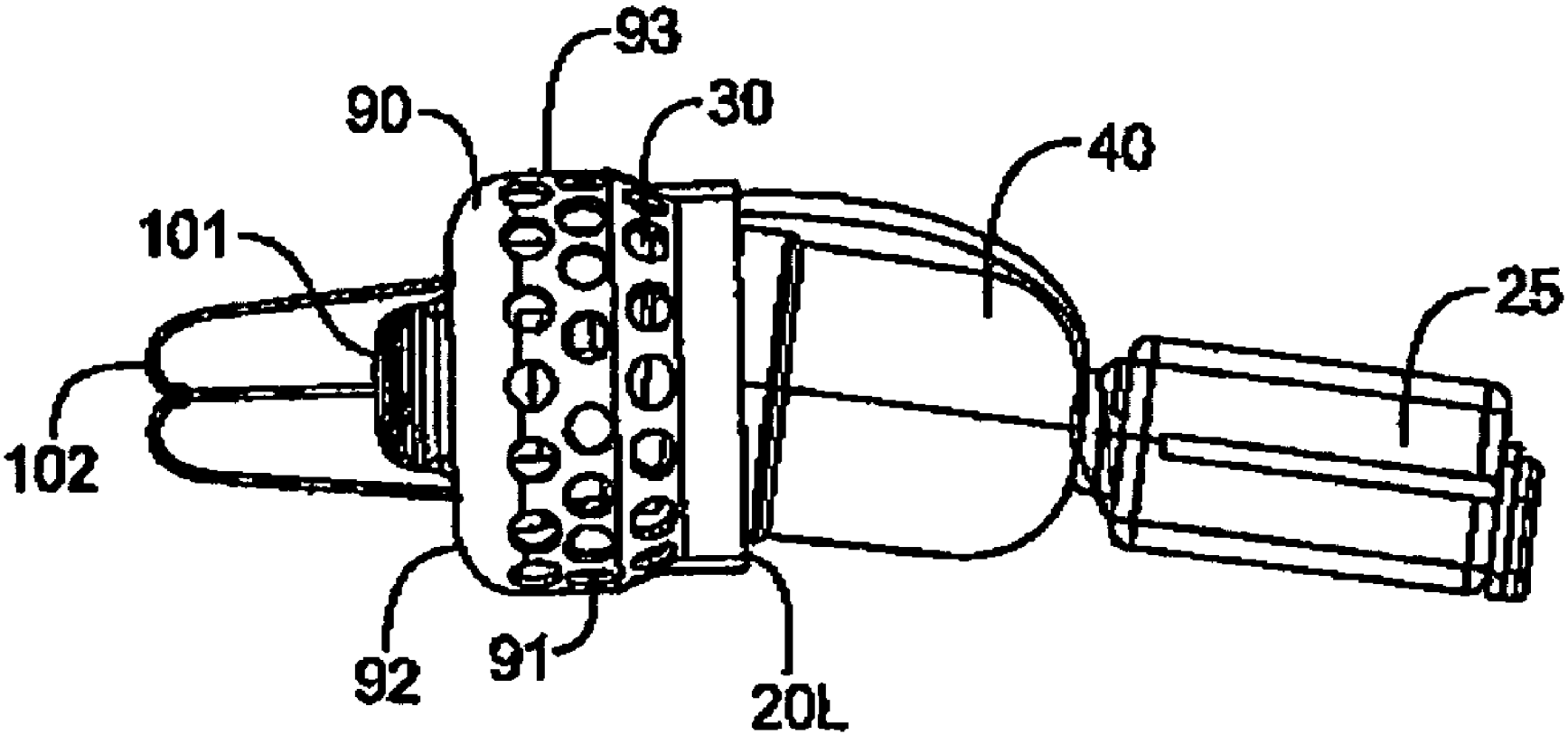
FIG. 4D is a side view illustrating the cap of FIG. 4A cap positioned onto a hearing aid.
Figure 4E:
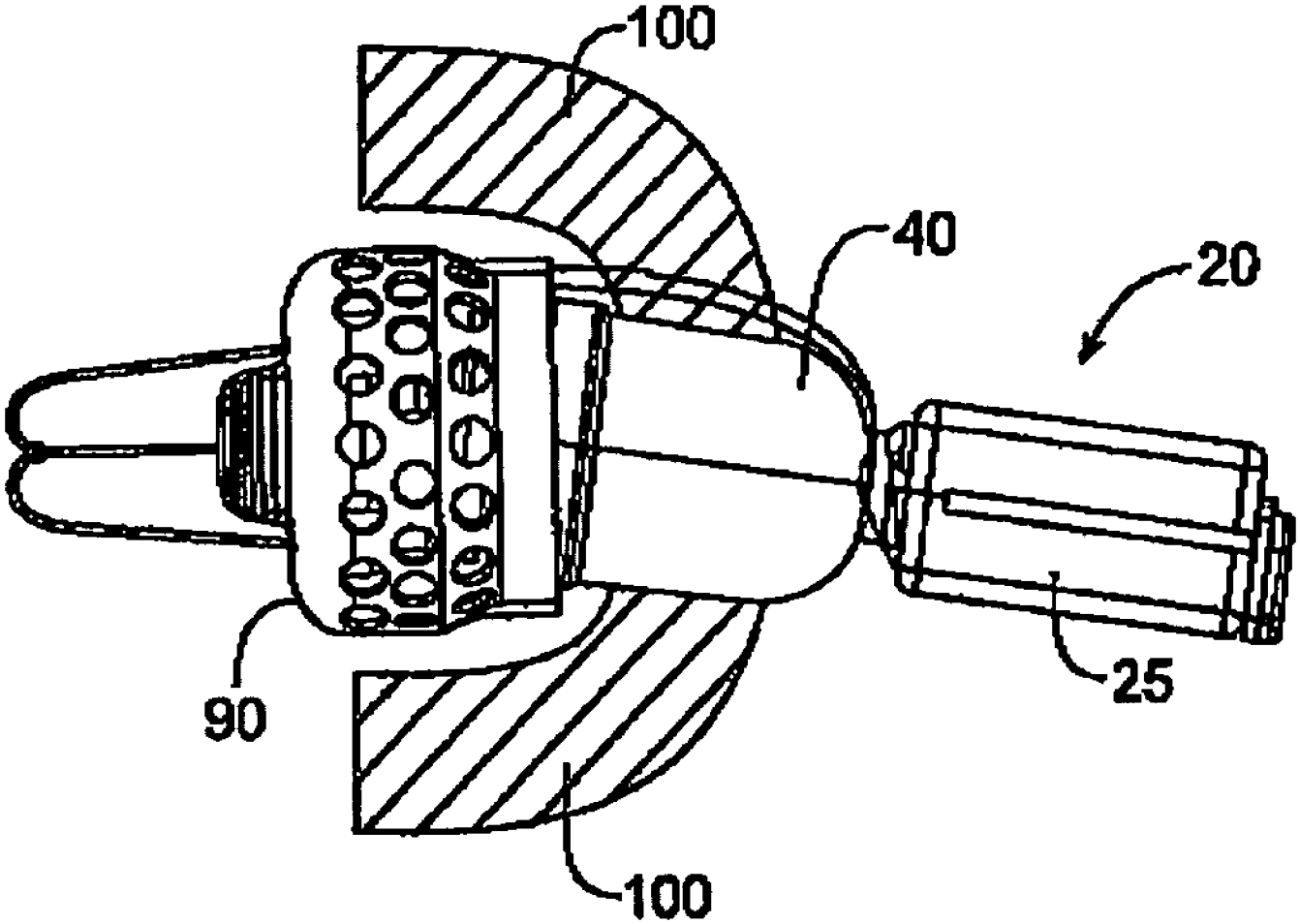
FIG. 4E is a side view illustrating the cap of FIG. 4A cap positioned onto a hearing aid and seated in a sealing retainer.

In many embodiments, the cap can include one or more fixtures for insertion and/or removal of the hearing aid. In an embodiment, an insertion fixture 101 can comprise an insertion tab attached to the top portion 93 of the cap as is shown in FIGS. 4A-4C. In various embodiments, a removal fixture 102 can comprise one or more wires loops attached to one or both of the top or side portions of the cap. Alternatively, the wires loops can also be attached to other portions of the hearing aid such as the microphone assembly or the battery assembly and in such embodiments the wire loops can be threaded through perforations 91. In a preferred embodiment, removal fixture 102 is a three pronged wire loop attached to the top portion of the cap as is shown in FIGS. 5A-5B. The wire can comprise 304V stainless steel, spring steel, NITINOL, surgical suture material such as polypropylene or other biocompatible material and may be coated with to enhance biocompatibility. Suitable suture material includes PROLENE available from Johnson & Johnson Inc. The cap can be attached to the hearing aid by screws or other joining means, adhesives, heating sealing, ultrasonic welding or other joining method known in the art. In embodiments having a removal fixture 102, the cap is attached to the hearing aid with sufficient mechanical strength (e.g., pull strength) such that when a removal tool engages the removal fixture the entire hearing aid is pulled out of the ear. In various embodiments, the side of the cap an also include one or more grooves, ridges or other raised portions or fittings used for aligning or locking the cap in place with other components of the hearing aid. Such features can comprise an alignment feature 103 or locking feature 104. In one embodiment, shown FIG. 4A an alignment feature 103 comprises a ridge near the bottom portion of the cap side.

In many embodiments, all or portions of cap 90 can include a protective coating 90*c*. Coating 90*c* can include one or both of a hydrophobic coating or an oleophobic coating known in the art. In a preferred embodiment, coating 90*c* is a flouropolymer coating known in the art that is both hydrophobic and oleophobic. Use of a hydrophobic coating reduces the amount of liquid water that enters into the cap interior 95 through splashing, submersion or via capillary action. In particular embodiments, a hydrophobic coating can be configured to enhance the splash guard properties of the cap (described herein). Use of an oleophophic coating serves to reduce the buildup of cerumen on the cap and in particular, reduces the propensity of cerumen to adhere to the cap and block perforations 91. In use, protective coating 90*c* provides a means for improving the long term reliability of the hearing aid by several means including: i) reducing the amount of liquid water entering into the cap and contacting moisture sensitive hearing aid components; ii) reducing the amount of cerumen and other contaminants entering into cap; and iii) reducing the amount of cerumen and other contaminants from fouling the cap perforations. Coating 90*c* can be applied using dip coating, spray coating or vacuum deposition and the like or other coating methods known in the art. The thickness of both coating 90*c* can be in the range of about 1 to 30 microns, with specific embodiments of 10, 20 and 25 microns. In alternative embodiments, coating 90*c* can also include an enzyme, enzymatic composition or other cerumenolytic agent or cerumenolytic composition 90A known in the art which is configured to chemically degrade adhered cerumen C causing it slough off or otherwise detach from the surface 90*s* of the cap. The agent 90A can be incorporated into the coating 90*c* and can be configured to be eluted by coating 90*c*. In use, such an cerumenolytic coating provides the cap with a self cleaning surface. Suitable cerumen degrading enzymes or agents include, without limitation, docusate sodium, triethanolamine polypeptide, aluminum acetate or benzethonium chloride and combinations thereof. In one embodiment, the cerumenolytic agent can be chemically compounded with an eluting agent known in the art such that the cerumenolytic agent 90A elutes or diffuses from surface 90*s* of the cap at a desired rate and concentration for an extended period, for example, three to six months or even longer.

Figure 6A:
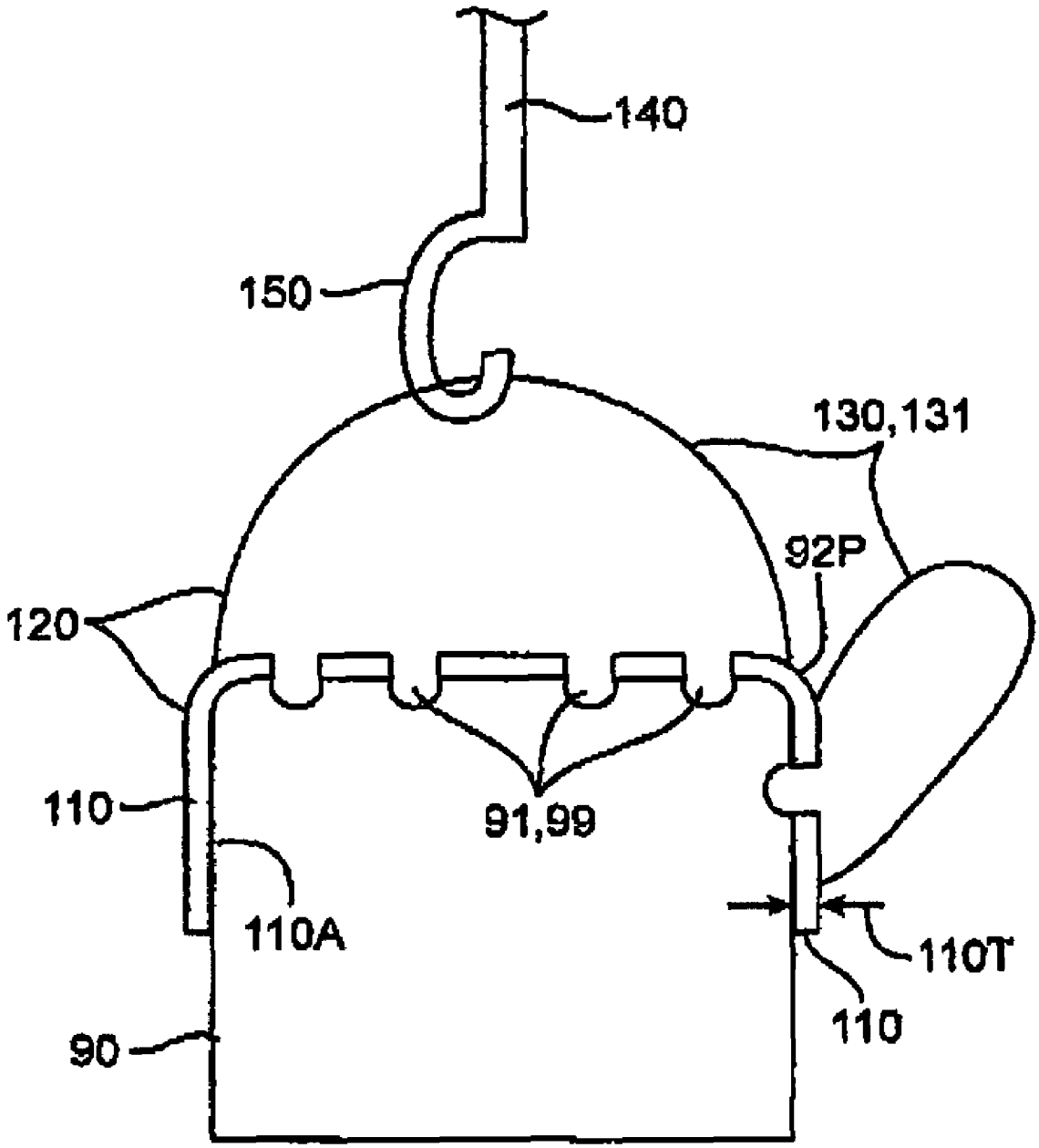
FIG. 6A is a side view illustrating an embodiment of the cap assembly including a peelable layer.
Figure 6B:
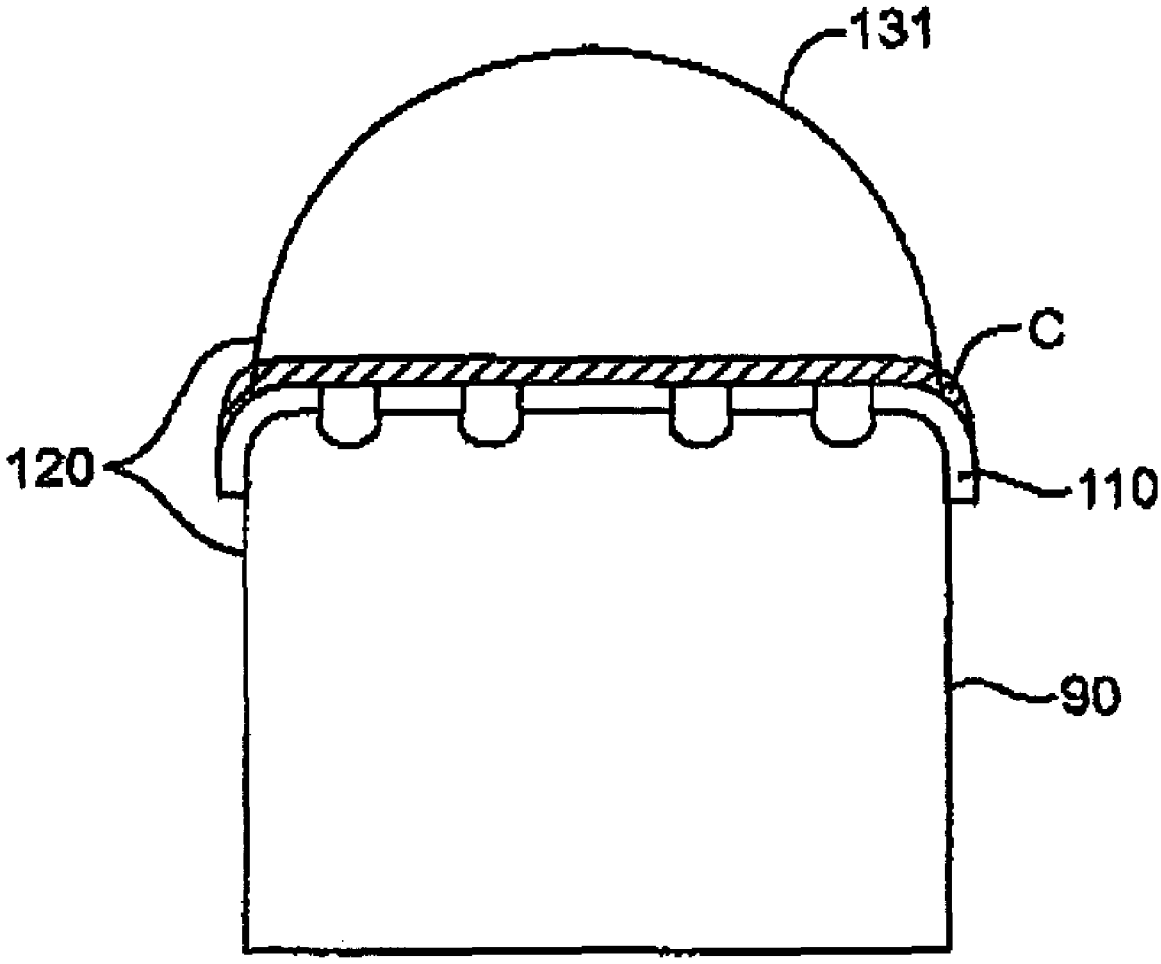
FIGS. 6B and 6C are side views illustrating use the of an embodiment of the cap assembly including a removable layer.
Figure 6C:
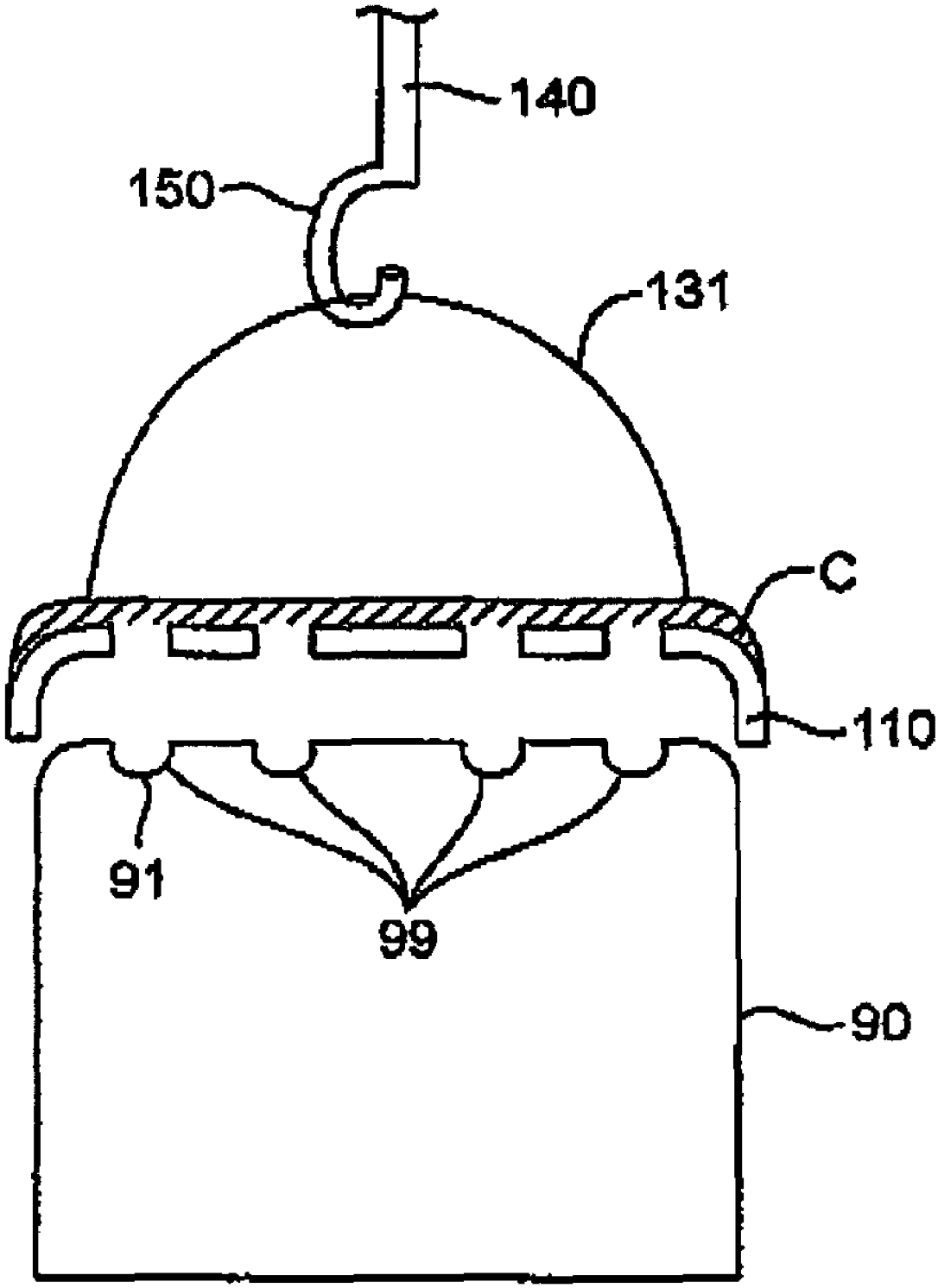

Referring now to FIGS. 6A-6C, in various embodiments, the cap can include one or more removable layers 110 attached to all or selectable portions of the cap. In one embodiment, removable layer 110 comprises a peelable layer held on via an adhesive as is described below. In various other embodiments, removable layer 110 can be removed via use of deformable tabs, or other releasable attachment means known in the art. Preferably, layer 110 covers at least the perforated portions of the cap. In one embodiment, the entire surface of the cap 90 is covered by a removable layer, in another, just the top portion 92. Also, each layer 110 can be configured to reveal new perforation 91 or even an entirely different set of perforations and/or a new pattern 99 of perforations.

In most embodiments, each removable layer includes an attached removal loop 131 or other removal mean 130 that allows in situ removal of the layer by a user or medical worker using a removal tool 140 that has one or more hooks or other grasping means 150 for engaging loop 131. The removable layer together with the removal means 130 are configured to function as a in situ cerumen removal system 120 such that when the layer is removed (e.g., by peeling) adhered cerumen C and other contaminants are removed along with layer 110, including cerumen or other contaminants that are blocking the perforations 91. Also a fresh region of the cap is revealed. In use, such a system allows a user to clean their hearing aid without undergoing the inconvenience of removal the hearing aid from the ear canal.

In one embodiment, removal means 130 comprises one or more suture loops, 131 threaded through one of more perforations 91 or attached to layer 110 by an adhesive means. Loops 131 can be positioned at various locations on layer 110/cap 90. In one embodiment, they can be attached centrally on cap top 92, in another embodiment one or more loops can be positioned near the perimeter 92P of cap top 92 or alternatively, one or more loops can be attached to the cap sides 93.

In many embodiments wherein the removable layer 110 is a peelable layer, layer 110 is attached to cap 90 using a releasable adhesive 110*a* known in the art. Typically, adhesive 110*a* is pre-applied to layer 110 (e.g. similar to adhesive tape) but can also be applied to cap 90 as well or a combination of both. Peelable layer 110 and the adhesive 110*a* are configured to allow the layer to be peeled without tearing of layer 110, that is the adhesive is a releasable adhesive known in the art and the layer has sufficient mechanical strength (e.g., tensile strength) to overcome the adhesive forces of the adhesive without tearing of the layer. The peelable layer is also configured to have sufficient mechanical strength so as to be able to pull away cerumen C that is adhered to the cap including cerumen protruding into perforations 91, without tearing of the peelable layer. The peel forces of layer 110 are also desirably configured such that they do not result in removal or significant movement of hearing aid 20 within the ear canal. Preferably, the peel strength of layer 110 is less about 0.04 lbs of force, more preferably less than about 0.03 lbs and still more preferably, less than about 0.02 lbs of force. In alternative embodiments, layer 110 can be attached to cap 90 by tabs (not shown) which are at least partially inserted into perforations 91. When a pull force is exerted on removal loop 131 (which is desirably centrally attached to layer 110/cap 90) it causes layer 110 to flex and pulls the tabs out, causing the entire layer to release with low force.

In various embodiments, the thickness 110T of a given peelable or other removable layer 110 can be in the range of 0.001" to about 0.006", with a specific embodiment of 0.003". Preferably, removable layer 110 is fabricated from a material that has one or more of the following properties: water resistance, cerumen resistance, dimensional stability and is machinable. In one embodiment, layer 110 can comprise a rigid vinyl plastic known the art.

The cap can include multiple peelable or other removable layers 110 such that multiple cerumen removing peals can be done over a period of extended wear of the hearing aid in the ear canal. In various embodiments, cap 90 can include between 2 to 10 layers, with a specific embodiment of 3 layers. Peels or other removals can be done at set time intervals (e.g. monthly) or whenever the user notices a perceptible degradation in performance of the hearing aid (e.g. decreased volume, clarity sound recognition, etc.). In this way, the user can wear the hearing aid for extended periods of time without degradation in performance due to cerumen/contaminant build up and without having to undergo the inconvenience of removing the hearing aid for purposes of cleaning. In one embodiment, the hearing aid can be configured to detect degradations in performance due to cerumen fouling and provide an audible or other signal to alert the user when to do a removal (e.g. pealing) procedure.

CONCLUSION

The foregoing description of various embodiments of the invention has been presented for purposes of illustration and description. It is not intended to limit the invention to the precise forms disclosed. Many modifications, variations and refinements will be apparent to practitioners skilled in the art. For example embodiments of the protective cap can be configured to protect any miniature acoustic or electronic device assembly positioned within the body, or otherwise placed in any humid environment and/or particulate contaminating environment. Further, the teachings of the invention have broad application in the hearing aid device fields as well as other fields which will be recognized by practitioners skilled in the art.

Elements, characteristics, or acts from one embodiment can be readily recombined or substituted with one or more elements, characteristics or acts from other embodiments to form numerous additional embodiments within the scope of the invention. Hence, the scope of the present invention is not limited to the specifics of the exemplary embodiment, but is instead limited solely by the appended claims.

What is claimed is:

1. A protective cap assembly for improving a resistance of an extended wear hearing aid to condensation and contaminants, the assembly comprising:

a cap configured to be mounted over at least a portion of the hearing aid, the cap including a plurality of perforations, a placement and size of the perforations configured to provide sufficient aeration and drainage to reduce a relative humidity of a cap interior when the hearing aid is positioned in an ear canal of a user, the perforations having a minimum size wherein a single perforation provides sufficient acoustic transmittance to a hearing aid component such that a hearing aid performance parameter is not substantially adversely affected.

2. The cap assembly of claim 1, wherein the placement and size of the perforations are configured to provide splash protection for the cap interior.

3. The cap assembly of claim 1, wherein the cap is configured to provide sufficient acoustic transmittance to a microphone positioned at least partially within the cap interior, the microphone being oriented in a medial direction of the ear canal.

4. The cap assembly of claim 1, wherein the cap is sized such that the cap does not make substantial contact with, or conform to a shape of the ear canal.

5. The cap assembly of claim 1, wherein the placement and size of the perforations are configured to provide sufficient aeration to equilibrate the relative humidity of the cap interior with an ambient humidity.

6. The cap assembly of claim 1, wherein the placement and size of the perforations are configured to have the cap function as a drain for an outward flow of liquid.

7. The cap assembly of claim 1, wherein a diameter of the perforation is in a range from about 0.010 to 0.0500 inches.

8. The cap assembly of claim 1, wherein a wall of the cap has a thickness in a range from about 0.001 to about 0.010 inches.

9. The cap assembly of claim 1, wherein the placement and size of the perforations are configured to inhibit condensation within the cap interior.

10. The cap assembly of claim 1, wherein the placement and size of the perforations are configured to inhibit ingress of a contaminant into the cap interior.

11. The cap assembly of claim 10, wherein the contaminant is cerumen, hair or skin.

12. The cap assembly of claim 1, wherein the perforations are arranged in a pattern.

13. The cap assembly of claim 12, wherein the pattern is configured to enhance at least one of aeration or acoustic transmittance.

14. The cap assembly of claim 1, wherein the cap is substantially cylindrically shaped and includes a top portion and a side wall portion having an open bottom.

15. The cap assembly of claim 14, wherein the perforations are positioned on both the top portion and the sidewall portion.

16. The cap assembly of claim 1, wherein the cap includes an insertion fixture.

17. The cap assembly of claim 16, wherein the insertion fixture is a tab.

18. The cap assembly of claim 1, wherein the cap includes a removal fixture.

19. The cap assembly of claim 18, wherein the removal fixture comprises a at least one wire loop.

20. The cap assembly of claim 1, wherein the cap includes an alignment feature configured to align the cap assembly with a hearing aid assembly.

21. The cap assembly of claim 20, wherein the alignment feature is a groove or a ridge.

22. The cap assembly of claim 1, wherein the hearing aid component is a microphone, a microphone oriented in a medial direction of the ear canal, a microphone assembly, a battery, a battery assembly or a receiver.

23. The cap assembly of claim 1, wherein the at least a portion of the hearing aid includes at least one microphone assembly, microphone positioned in a medial direction, battery assembly, or receiver assembly.

24. The cap assembly of claim 1, wherein the cap is configured as a receptacle for at least one of a microphone assembly, an electronic assembly, an integrated circuit, a battery assembly, a battery, a speaker assembly or an electrical connector.

25. The cap assembly of claim 1, wherein the cap is configured to be sealed against at least one of a grommet, a battery assembly or a battery barrier membrane.

26. The cap assembly of claim 1, wherein the performance parameter is one of a hearing aid output, a hearing aid volume or a hearing aid gain.

27. The cap assembly of claim 1, wherein at least a portion of the cap is covered by a protective coating.

28. The cap assembly of claim 27, wherein the protective coating includes at least one of a hydrophobic coating, an oleophobic coating, a fluoro-polymer coating, an enzymatic coating, or a cerumenolytic coating.

29. The cap assembly of claim 27, wherein the protective coating is configured to inhibit cerumen adherence or build up on a surface of the cap.

30. The cap assembly of claim 1, wherein the cap is configured to be coupled to a lateral end of the hearing aid.

31. The cap assembly of claim 1, wherein the cap is configured to be coupled to an extended wear hearing aid placed in a bony portion of the ear canal.

32. A protective cap assembly for improving a resistance of an extended wear hearing aid worn in a bony portion of an ear canal to condensation and contaminants, the assembly comprising:

a cap configured to be coupled to a lateral end of the hearing aid, at least a portion of the cap including a protective coating, the cap including a plurality of perforations, a placement and size of the perforations configured to provide splash protection for an interior of the cap while providing sufficient aeration and drainage to minimize condensation in the cap interior, the perforations having a minimum size wherein a single perforation provides sufficient acoustic transmittance to a hearing aid component such that a hearing aid performance parameter is not substantially adversely affected.

33. A self-ventilated protective cap assembly for improving a resistance of an extended wear hearing aid to condensation and contaminants, the assembly comprising:

a cap configured to be mounted over at least a portion of the hearing aid, the cap including a protective coating and a plurality of perforations, a placement and size of the perforations configured to provide splash protection for an interior of the cap while providing sufficient aeration and drainage to reduce a relative humidity of the cap interior when the hearing aid is positioned in an ear canal of a user, the perforations having a minimum size wherein a single perforation provides sufficient acoustic transmittance to a hearing aid component such that a hearing aid performance parameter is not substantially adversely affected.

34. An extended wear CIC hearing aid for operation in a bony portion of an ear canal of a user, the hear aid comprising:

a microphone assembly;

a receiver assembly configured to supply acoustic signals received from the microphone assembly to a tympanic membrane of the user;

a battery assembly for powering the hearing aid, the battery assembly electrically coupled to at least one of the microphone assembly or the receive assembly; and the cap assembly of claim 33, wherein the cap is coupled to or mounted over at least a portion of at least one of the microphone assembly or the battery assembly.

35. The hearing aid of claim 34, wherein the cap includes a protective coating.

* * * * *